US008562083B2

(12) United States Patent
McClure

(10) Patent No.: US 8,562,083 B2
(45) Date of Patent: Oct. 22, 2013

(54) DOUBLE BENCH WITH CABINET

(76) Inventor: J. William McClure, East Sound, WA (US)

( * ) Notice: Subject to any disclaimer, the term of this patent is extended or adjusted under 35 U.S.C. 154(b) by 1051 days.

(21) Appl. No.: 12/016,645

(22) Filed: Jan. 18, 2008

(65) Prior Publication Data

US 2009/0184612 A1 Jul. 23, 2009

(51) Int. Cl.
*A47B 83/00* (2006.01)

(52) U.S. Cl.
USPC ..... 312/235.9; 312/235.2; 297/188.03

(58) Field of Classification Search
USPC ..... 312/235.2, 235.4, 235.5, 235.9, 237, 312/240; 297/188.03, 188.08, 217.1; 211/34, 36, 37
See application file for complete search history.

(56) References Cited

U.S. PATENT DOCUMENTS

| | | | | | |
|---|---|---|---|---|---|
| 130,566 | A | * | 8/1872 | Byrnes | 312/205 |
| 797,826 | A | * | 8/1905 | Sherman, Jr. | 312/235.2 |
| 1,188,974 | A | * | 6/1916 | Montgomery | 312/258 |
| 1,289,833 | A | * | 12/1918 | Lohr | 312/227 |
| 1,447,145 | A | | 2/1923 | Morell | |
| 1,505,829 | A | | 8/1924 | Wanrnecke | |
| 2,227,803 | A | * | 1/1941 | Bales | 70/264 |
| 2,607,946 | A | | 8/1952 | Price | |
| 2,628,145 | A | * | 2/1953 | Slattery | 312/205 |
| 2,948,577 | A | * | 8/1960 | Hansen | 312/264 |
| 3,104,139 | A | * | 9/1963 | Thompson | 312/235.5 |
| 3,294,464 | A | * | 12/1966 | Lew | 312/258 |
| 3,563,390 | A | | 2/1971 | Kim | |
| 3,888,353 | A | | 6/1975 | Leifheit | |
| 4,165,124 | A | | 8/1979 | Olan | |
| 5,104,208 | A | | 4/1992 | Gesing | |
| 5,735,586 | A | * | 4/1998 | Cheng | 312/235.1 |
| D398,787 | S | | 9/1998 | Malik | |
| D403,880 | S | | 1/1999 | Malik | |
| 6,086,171 | A | | 7/2000 | Ashley | |
| 6,145,931 | A | | 11/2000 | Subotic | |
| 7,040,695 | B2 | * | 5/2006 | McClure | 297/188.08 |
| 2002/0060491 | A1 | | 5/2002 | Kneier | |

FOREIGN PATENT DOCUMENTS

| | | |
|---|---|---|
| JP | 410033276 | 2/1998 |

* cited by examiner

*Primary Examiner* — James O Hansen
(74) *Attorney, Agent, or Firm* — Charles McCluskey

(57) ABSTRACT

A wooden piece of furniture for changing shoes has a cabinet with two parallel benches upon the sides of the cabinet. Each bench has a seat and storage rack beneath the seat. At the end of each bench, a cabinet stores slippers, footwear, and outerwear upon shelves behind doors and within a drawer. This furniture also includes a compartment within the cabinet for hanging storage of items, hooks within the compartment, seats stiffened by rails and a beam, and a cabinet stiffened by panel diaphragm action. This furniture can store both footwear and articles of clothing temporarily placed thereon by guests and other visitors.

3 Claims, 5 Drawing Sheets

DOUBLE BENCH WITH CABINET

CROSS REFERENCE TO RELATED APPLICATION

This application is related to the non-provisional application Ser. No. 10/794,902, now U.S. Pat. No. 7,040,695, commonly owned by the same inventor.

BACKGROUND OF THE INVENTION

The present invention relates to a Double Bench with Cabinet for use in connection with furniture near an entrance to a home. The Double Bench with Cabinet has particular utility in storing footwear near where a guest removes the footwear.

The double bench with cabinet is desirable for assisting guests in changing from street shoes to slippers or other footwear suitable for the indoors. In the Orient and in certain religious sects, guests remove shoes upon entering a house. Shoe removal honors the owner, follows custom, and promotes cleanliness. The shoe removal custom has gained in popularity in America, starting in upper class homes. Typically, guests enter a home, remove their shoes, and don slippers, moccasins, or other indoor footwear. The slippers put guests in a more relaxed state of mind and separate the home from the outside world. Slippers also protect the floors and contents of a home from wear and tear. At times, shoes and slippers accumulate in unsightly piles and guests require assistance in removing and donning footwear. Upon departure, guests remove the slippers, don their shoes and coats, and depart the home.

DESCRIPTION OF THE PRIOR ART

The use of a bench cabinet is known in the prior art. For example, U.S. Pat. No. 4,165,124 to Olan describes a chair with storage cabinets on each side and a footrest in front. This combination chair has an upholstered seat, footrest, and two cabinets. Further, this patent discloses cabinets next to a chair to assist in changing shoes. Meanwhile, the present invention has two plain benches flanking a single cabinet.

Similarly, U.S. Pat. App. 2002/0060491 to Kneier describes a chair with a storage bin beneath forming a footrest akin to a step. This chair has a footrest beneath and in front of the seat. The present invention has a bench with one cabinet to the side and an open shoe rack beneath the bench.

Similarly, U.S. Pat. No. 6,086,171 to Ashley et al. shows a cabinet for storing and retrieving shoes without a seat. The cabinet has spokes from a hub between two rings and lacks a bench. The present invention lacks a carousel storage system.

U.S. Pat. No. 3,563,390 to Kim shows another cabinet for storing shoes with doors and rails for a shoe rack. The cabinet describes storing shoes—toes up—on racks that pull out of the cabinet behind doors with shoe pockets. The present invention stores shoes generally flat on fixed rungs or a sheet beneath the seat.

U.S. Pat. No. 5,104,208 to Gesing represents a cabinet with two compartments for storing shoes vertically then displaying shoes horizontally when pulled down. The present invention lacks pull down compartments and has a bench.

U.S. Pat. No. 3,888,353 to Leifheit illustrates cross ties formed into a rack to store shoes. The cross ties span between stackable supports. The present invention has a vague resemblance to cross ties in the rungs as the display means but also has a cabinet and bench unlike Leifheit '353.

U.S. Pat. No. D398,787 & D403,880 to Malik illustrate a rack for storing shoes similar to Leifheit's patent above. These racks have rails between rectangular supports with connecting points forming a stackable assembly. Lacking a bench and a cabinet, these racks substantially differ from the present invention.

U.S. Pat. No. 6,145,931 to Subotic shows a retractable footrest within a stool. The footrest has a cammed extending arm and a pull out tray. The present invention lacks an extending arm and adds a cabinet in contrast to Subotic's invention.

U.S. Pat. No. 1,505,829 to Warnecke shows a dressing chair with a pull out footrest with a coat hanger shaped back, trouser rollers, and no cabinet. The present invention omits a footrest while including a cabinet.

U.S. Pat. No. 2,607,946 to Price et al. shows an unusual shape for a stool with another pull out footrest and an upholstered seat. This stool lacks a backrest and a side cabinet while using conic sections to form the seat.

U.S. Pat. No. 1,447,145 to Morell et al. shows a seat atop a portable case for shoes with hinged panels. This case lacks a cabinet beside the seat while having casters for movement. The present invention has a cabinet adjacent to a seat and a fixed location.

And the Japanese publication JP410033276 to Eto has a bench with a handrail 4 upon one end and a tall unit 5 or cabinet upon the opposite end. The bench is provided for the disabled, elderly, frail, and young. An overhead closet unit 6 joins the tall unit to the handrail. The bench and tall unit rest upon the architrave 3 or plinth, a common planar part. The architrave hangs from, or is supported upon one end by, an indoor floor 7 and legs upon the opposite end. The legs extend to an earthen floor 8. The indoor floor and earthen floor are shown at differing elevations, such as a step. Though the reference discloses a cabinet next to a bench, the reference does not stand by itself upon a flat surface as does the present invention.

While the above-described devices fulfill their respective, particular objectives and requirements, the aforementioned patents do not describe a Double Bench with Cabinet that stores footwear beneath a seat and provides slippers. The '124 and '931 patents and '491 application do not provide a single cabinet adjacent to a seat. The '171 patent does not store shoes in fixed compartments within a cabinet. While the '390 patent does stores shoes angularly upon on a stationary platform. The '208 patent omits fixed horizontal compartments and a bench. The '353 patent describes rungs but makes no provision for a bench or cabinet. The D'787 & D'880 patents show racks without permanent attachment to a bench. The '829 patent makes no provision for a cabinet. The '946 patented stool and '145 patented seat case also lack an adjacent cabinet.

Therefore, a need exists for a new and improved Double Bench with Cabinet that can be used for providing slippers or other indoor footwear to guests and for storing their shoes and outwear. In this regard, the present invention substantially fulfills this need. In this respect, the Double Bench with Cabinet according to the present invention substantially departs from the conventional concepts and designs of the prior art, and in doing so provides a device primarily developed for the purpose of assisting guests in storing shoes and articles of clothing upon entering a home or office.

SUMMARY OF THE INVENTION

In view of the foregoing disadvantages inherent in the known types of shoe storing cabinets now present in the prior art, the present invention provides an improved Double Bench with Cabinet, and overcomes the above-mentioned disadvantages and drawbacks of the prior art. As such, the general purpose of the present invention, which will be described subsequently in greater detail, is to provide a new and improved Double Bench with Cabinet which has all the advantages of the prior art mentioned heretofore and many novel features that result in a Double Bench with Cabinet which is not anticipated, rendered obvious, suggested, or even implied by the prior art, either alone or in any combination thereof.

To attain this, the present invention essentially comprises a wooden piece of furniture for changing shoes that has a cabinet with two parallel benches upon the sides of the cabinet. Each bench has a seat and shoe storage means under the seat. At the end of each bench, a cabinet stores slippers, footwear, and outerwear in compartments behind doors and within a drawer. There has thus been outlined, rather broadly, the more important features of the invention in order that the detailed description thereof that follows may be better understood and in order that the present contribution to the art may be better appreciated.

The piece of furniture may also include storage means formed by rungs running lengthwise under the benches or by a planar sheet. The cabinet stores footwear and outerwear in compartments above a drawer. Additional features of the invention will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and devices for carrying out the several purposes of the present invention. It is important, therefore, that the claims be regarded as including such equivalent constructions insofar as they do not depart from the spirit and the scope of the present invention.

It is therefore an object of the present invention to provide a new and improved double bench with cabinet that has all of the advantages of the prior art bench cabinets and none of the disadvantages.

It is another object of the present invention to provide a new and improved double bench with cabinet that may be easily and efficiently manufactured and marketed.

Still another object of the present invention is to provide a double bench with cabinet for assisting guests in changing shoes for indoor footwear when seated.

Still another object of the present invention is to provide a double bench with cabinet for assisting guests in changing shoes and then storing the guests' shoes neatly beneath a seat.

Still another object of the present invention is to provide a double bench with cabinet for assisting guests in storing articles of clothing concealed from view and either laying flat or hanging.

Still another object of the present invention is to provide a double bench with cabinet for assisting guests in placing transitory articles, such as keys, phones, purses, newspapers, and the like, at waist height for collection after changing shoes when seated.

Lastly, it is an object of the present invention to provide a double bench with cabinet for assisting guests in changing shoes that limits the tracking of debris from the street through a house.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
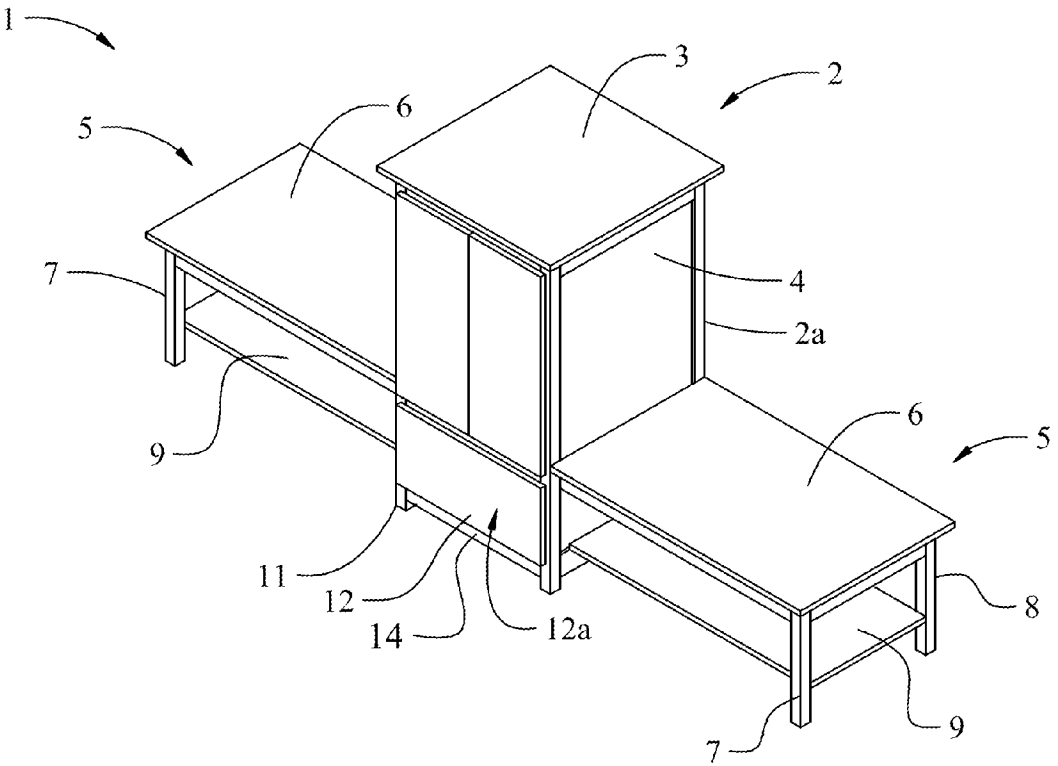
FIG. 1 is a perspective view of the preferred embodiment of the present invention.

Referring now to the drawings, and particularly to FIGS. 1-8, a preferred embodiment of the double bench with cabinet of the present invention is shown by the reference numeral 1. In FIG. 1, the present invention 1 has a centered cabinet 2 having a front seen by people when the invention is installed, a lid 3 perpendicular to the front, a back opposite the front generally not seen by people, and two parallel spaced apart sides 4. Upon each side, the cabinet has a bench 5 extending outwardly, generally perpendicular to the front. Each bench 5 begins with a seat 6, generally planar and rectangular with the length of the seat coaxial with the length of the present invention 1 and having two opposite ends and four corners. Upon one end and one corner, the seat 6 has a front leg 7 depending from it. Opposite the front leg upon the same end of the seat, a rear leg 8 joins the seat 6. The rear leg 8 has a generally parallel alignment to the front leg 7 and the seat 6 joins the rear leg at the same elevation as the front leg. Beneath the seat 6, the furniture has a storage rack 9 to store shoes and other items. Preferably, the storage rack has the form of a planar sheet generally parallel to the seat. In an alternate embodiment, the storage rack is at least two mutually parallel rungs below the seat.

Opposite the front leg and the rear leg, the seat 6 joins to the cabinet 2 on the end opposite the front leg 7 and the rear leg 8. The wooden cabinet 2 has a generally rectangular carcass 2*a*, two doors 10 and depending feet 11 beneath the carcass. The doors 10 are mutually parallel, upon the front of the invention, and hingedly connected to the cabinet towards the end of the seats outwardly from the cabinet. Each door pivots on a vertical axis offset from the longitudinal axis of the door and opens away from the cabinet, laterally, towards the front of the invention, generally attaining a parallel orientation to a side 4 when opened. Beneath the doors 10, the cabinet has a drawer 12 that extends for the depth of the cabinet. The drawer has its own front 12*a*, generally flush with the doors 10 and made of similar material as the doors. The drawer has four walls and a base panel that contains items stored within. The drawer pulls forward and out of the cabinet for ease in removing items. The drawer moves upon slides installed within the cabinet upon each side. Behind the door 10, the furniture has additional storing means for footwear, clothing, and other items.

Figure 2:
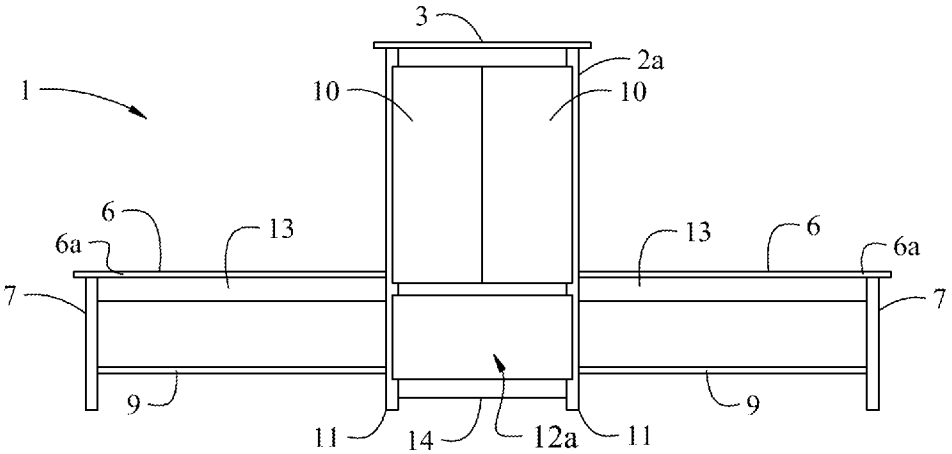
FIG. 2 is a front view of the present invention.

Turning to FIG. 2, the present invention appears in a view as seen by people in front of the invention. The invention 1 has a cabinet 2 flanked by a bench 5 upon each side, generally arranged in a linear fashion. Each bench has a seat 6 as before supported upon a rail 13. The rail extends generally horizontally from the cabinet at the side 4 to the front leg 7. The rail stiffens the front edge 6*a* of the seat for the comfort of people using the bench. In this view, each seat extends slightly beyond, or outwardly, from the front leg. The cabinet as before has a carcass 2*a*, generally rectangular with its length extending perpendicular to the length of the entire invention. The carcass extends below the plane of the seats to four feet 11, two shown in this view, where the feet 11 are coplanar with the tips of the front legs 7 and the rear legs 8. Spanning between each foot 11 and generally below the plane of the storage racks 9, a girt 14 is generally parallel to the rails 13 and the lid 3. The girt connects two of the feet of the carcass and retains the rectangular shape of the front of the cabinet. The girt also supports the drawer 12 as it moves inwardly and outwardly.

Figure 3:
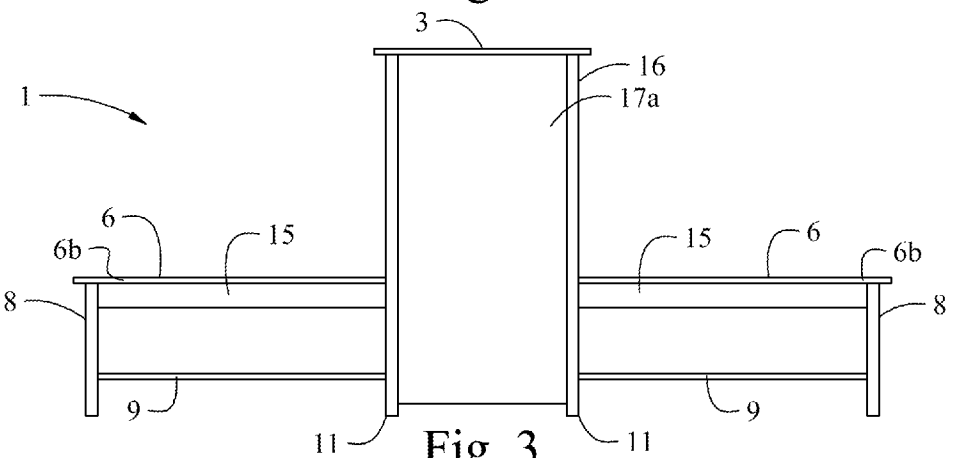
FIG. 3 shows a rear view of the present invention opposite FIG. 2.

Opposite FIG. 2, FIG. 3 shows the rear of the invention, generally placed against a wall when the invention is installed. The invention has two benches 5 outwardly of the sides 4 of a cabinet 2. Each bench has a seat 6 generally in a horizontal plane and a rear edge 6*b* mutually parallel and spaced apart from the front edge. A beam 15 extending from both rear legs 8 and through the cabinet supports the rear edges 6*b*. The beam stiffens the rear edges for the comfort of the users and provides rigidity to the invention.

Between the benches, the invention has the cabinet with the rear of its carcass shown in FIG. 3. The lid 3 rests upon the top of the carcass, generally above the benches. Beneath the lid, two mutually parallel and spaced apart frames 16 descend to the seats and connect to the beam 15, the storage racks 9, and terminate in two feet 11. Proximate the feet, the carcass has another girt 14 spanning between the feet mutually parallel to the girt between the feet in FIG. 2. Outwardly from the beam and the girt, the rear of the carcass has a back panel 17*a* extending from the girt to beneath the lid. The back panel has a generally rectangular shape that secures to the lid, the frames, and the girt upon the perimeter. The stiffness of the back panel provides rigidity to the cabinet.

Figure 5:
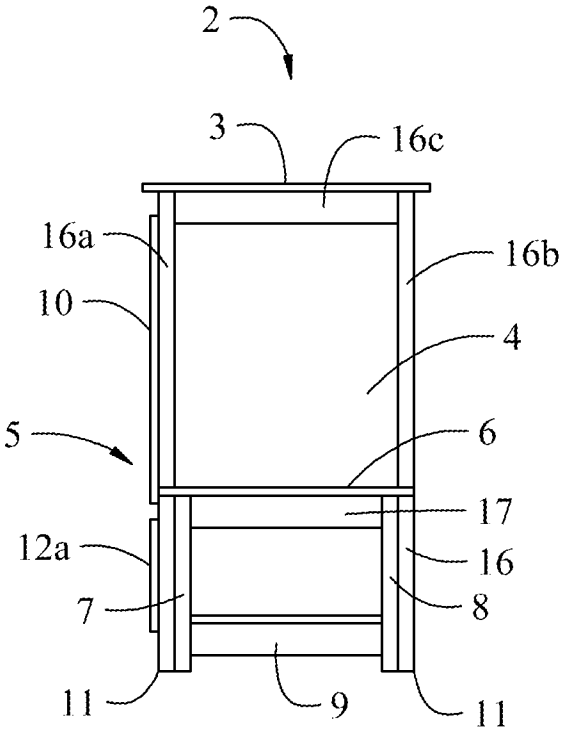
FIG. 5 describes a side view opposite FIG. 4.
Figure 4:
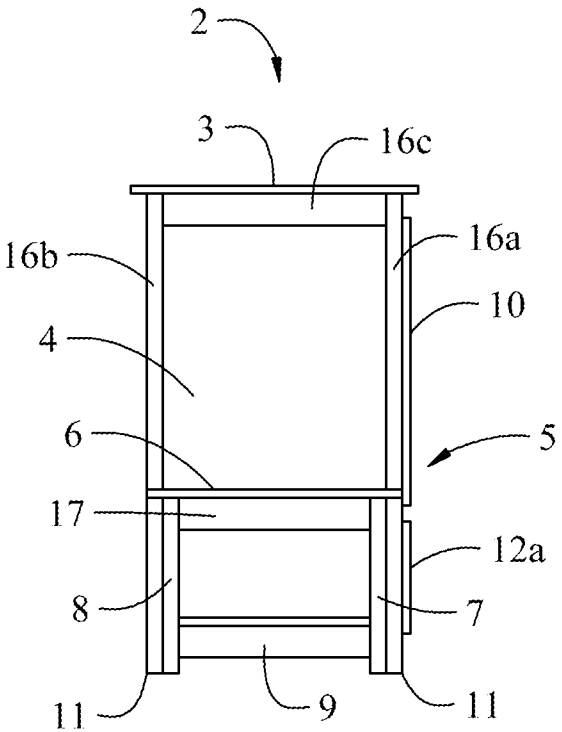
FIG. 4 illustrates a side view of the double bench with cabinet.

Turning the invention again, a left end view of the present invention 1 appears in FIG. 4 with its mirror image, the right end view shown in FIG. 5. As these views are mirror images, one end will be described. On each end, the present invention 1 has the seat 6 with the front leg 7 perpendicular to the seat and to the length of the present invention. The seat 6 attaches generally to the top of the front leg. The rear leg 8 attaches to the seat laterally opposite to the front leg 7. The storage rack 9 has a spacer 17 spanning between the front leg and the rear leg just below the seat. The spacer stiffens the outward edge of the seat, again for the comfort of the users. As in FIG. 1, the cabinet 2 has doors 10 with one shown on edge in this view. The doors extend down from proximate the lid 3 to just below the seat 6. Beneath the doors, the invention has a drawer with the drawer front 12*a* in the same plane as the doors. The doors and drawer fit within the cabinet. The cabinet has a carcass behind the doors and drawer formed of frames 16 with sides 4. Each frame has a front member 16*a* mutually parallel and spaced apart from a rear member 16*b* also connected by a spacer 16*c* just below the lid 3. This spacer 16*c* has slightly greater length than spacer 17. Within the front member and rear member, the carcass has a side 4 to the left and the right. The side provides stiffness to the cabinet and the invention in cooperation with the spacers 17, the storage racks 9, and the front and rear legs.

Figure 6:
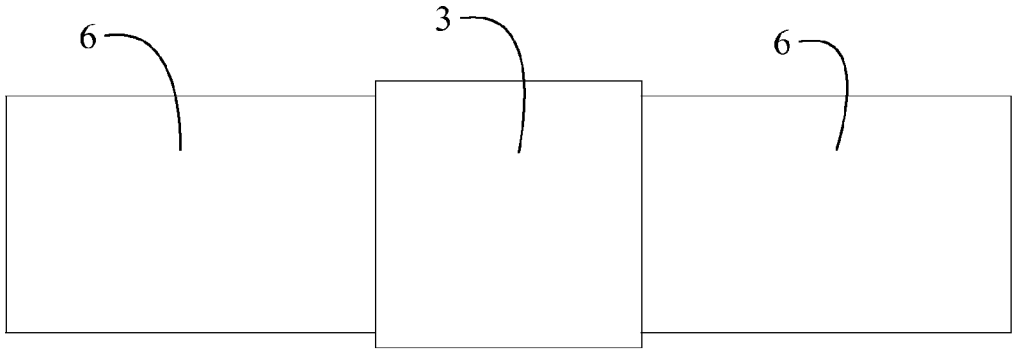
FIG. 6 provides a top view of the present invention.

And FIG. 6 shows a top view of the present invention with the cabinet centered between two benches. The cabinet has the lid 3 in the center with the seats 6 extending to the left and the right of the lid. The lid generally has a slightly greater width than the seats and the lid slightly overhands the cabinet. More particularly, the lid extends outwardly upon its four sides beyond the planes of the doors, the sides, and the back panel. In this embodiment, the lid and the seats are in parallel planes. In an alternate embodiment, the seats are in parallel planes with the lid in its own plane or planes.

Figure 7:
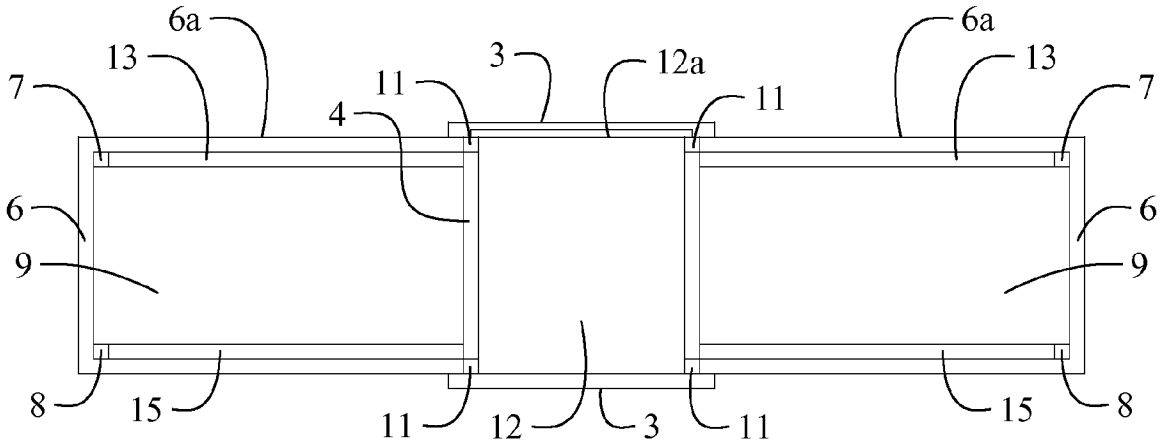
FIG. 7 provides a bottom view of the double bench with cabinet.

From below, FIG. 7 shows the invention 1 beneath the carcass 2*a* and the seats 6 where, four feet 11 depend to a plane coplanar with the bottom of the front legs 7 and the rear legs 8. As before, the cabinet begins with a lid 3 upon its uppermost here shown as a narrow band as the lid is concealed by the carcass. Upon the front of the invention and below the doors, the carcass has the drawer with the drawer front 12*a* shown below the lid in this view. Behind the drawer front, the drawer 12 extends from the front to the rear of the carcass. Opposite the drawer front in this view, the rear of the drawer has the lid showing behind it. The drawer 12 is contained within the front members 16*a* and the rear members 16*b* and the sides 4.

In the preferred embodiment, the invention is symmetric so the description of the one bench following applies to both benches, one on each side of the cabinet. In this view, each storage rack 9 extends perpendicular to the side 4, outwardly from the cabinet. The rack connects to the side using customary carpentry joints. Opposite the side, the rack connects to the front leg 7 and the rear leg 8 at each corner. Between the front member 16*a* and the front leg 7, the rail 13 spans and supports the seat along its edge 6*a*. Mutually parallel and spaced behind the rail, the beam 15 extends from the rear legs 8 inwardly along the back 17 of the cabinet. The beam supports the rear edge 6*b* of the seat. The seat then extends outwardly from the rail and the beam, defining the depth of the benches.

Figure 8:
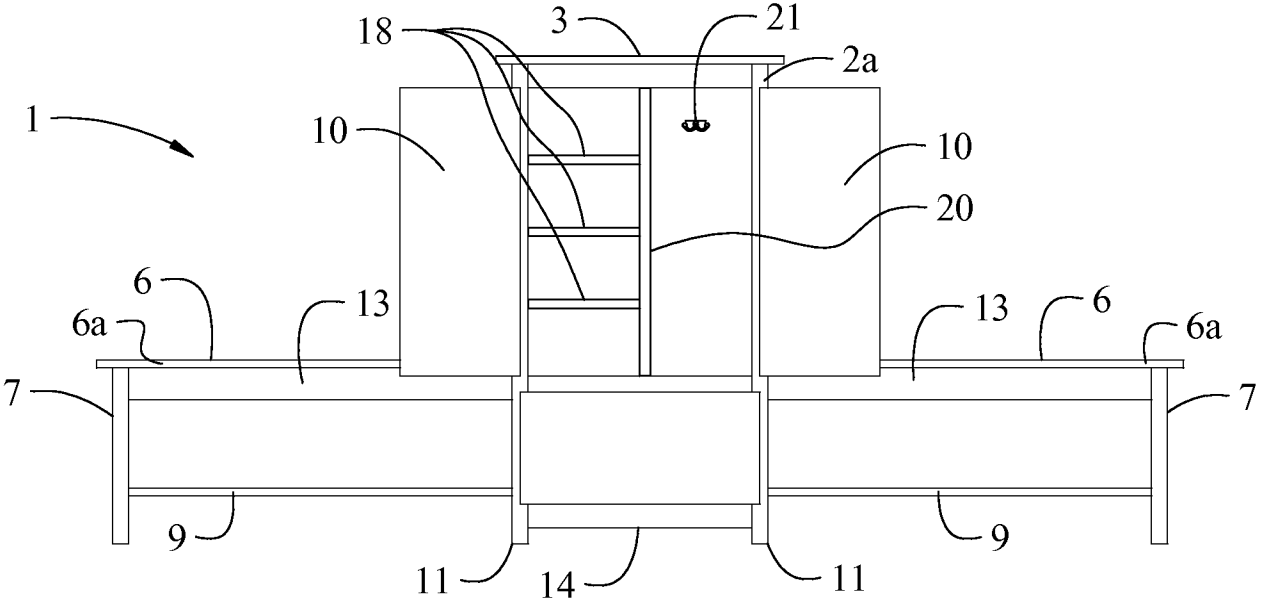
FIG. 8 shows a view of the interior of the cabinet of the present invention.

Opening the doors 10, FIG. 8 shows additional storage features including shelves 18 and a compartment 19. The shelves are generally horizontal and extend partly across the width of the interior of the cabinet. The shelves extend from the side inwardly to an upright 20. The upright extends from the bottom of the cabinet up to beneath the lid while being generally parallel to the front members 16*a*. Opposite the shelves, the upright defines the compartment the extends for the height of the cabinet. The compartment has hooks 21 extending from the upright for hanging various items within the cabinet. In an alternate embodiment, the compartment has additional hooks upon the interior of the side opposite the upright. Though two shelves are shown, additional or fewer shelves are foreseen as alternate embodiments. In a further alternate embodiment, the interior of the cabinet is empty. The cabinet provides plenty of storage for the users of the invention.

In use, a homeowner places the double bench with cabinet 1 in an entryway or near the front door of a home or office. Upon a guest's arrival, the homeowner greets the guest and takes the guest's coat for placement in the cabinet. If desired, the guest sits upon the bench 5 and removes shoes to be replaced by indoor footwear such as slippers. The guest then places the shoes upon the storage rack 9 beneath the seat 6. Opening the doors 10 to the cabinet 2, the guest places any remaining items upon a shelf. At departure, the guest returns to the seat 6 and replaces indoor footwear with shoes. The guest removes any items from the shelves and compartment and then departs.

While a preferred embodiment of the double bench with cabinet has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic, metal, composite, stone, or a variety of wood may be used instead of the wooden furniture described. Although assisting guests in removing and storing shoes in a home has been described, it should be appreciated that the double bench with cabinet herein described is also suitable for entries at offices, factories, hospitals, clean rooms, and mines.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A piece of furniture for storing footwear and clothing, comprising:

a cabinet having two doors hingedly connecting to said cabinet and opening outwardly from the center of said cabinet, said doors revealing the interior of said cabinet when open, and at least one drawer beneath said doors;

said cabinet having a lid, two mutually parallel and spaced apart sides, each of said sides connecting to one of said benches, a back panel, generally opposite said doors, and two mutually parallel and spaced apart frames containing said sides and said frames connecting generally perpendicular to said back panel;

each of said frames having a front member spanning from said lid to an opposite foot and a rear member spanning from said lid to an opposite foot, said feet of said frames being coplanar;

a girt joining said front members and being generally perpendicular to said frames and generally above said feet and below said at least one drawer;

two benches locating outwardly of said cabinet, each of said benches having a storage rack;

said cabinet including at least one shelf, generally horizontal, and an upright within said cabinet, said upright being mutually parallel to one of said sides and spaced away from said side, said upright extending from proximate said drawers to beneath said lid;

said at least one shelf extending from said side to said upright and being separate from said doors; and, said upright and said side defining a compartment, said upright having at least one hook thereon adapted for hanging articles, and said compartment extending from proximate said drawers to beneath said lid.

2. The piece of furniture of claim 1, further comprising:

each of said benches having a seat, generally planar and extending outwardly from one of said sides, said seat locating above said storage rack, a front leg and a mutually parallel and spaced apart rear leg, said front leg and said rear leg locating opposite said side wherein said seat generally remains horizontal and said seat is supported upon said side and said front leg and said rear leg;

each of said benches having a rail extending from said cabinet to said front leg beneath an edge of said seat; a beam extending from one of said rear legs to said cabinet across said back panel and to the other of said rear legs; and, each of said benches having a spacer extending from said front leg to said rear leg beneath an edge of said seat wherein said spacer, said rail, and said beam join to said seat and thus stiffen the perimeter of said seat.

3. The piece of furniture of claim 1, wherein said storage rack is a planar sheet spanning between said front leg, said rear leg, and said cabinet below and generally parallel to said seat, said storage rack extends perpendicular to said side and proximate said girt, wherein a guest stores items upon said planar sheet.

* * * * *